US006600453B1

(12) United States Patent
Hadden, IV et al.

(10) Patent No.: US 6,600,453 B1
(45) Date of Patent: Jul. 29, 2003

(54) SURFACE/TRAVELING WAVE SUPPRESSOR FOR ANTENNA ARRAYS OF NOTCH RADIATORS

(75) Inventors: John M. Hadden, IV, Redondo Beach, CA (US); Robert G. Yaccarino, Torrance, CA (US); Lonny R. Walker, Torrance, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/062,337

(22) Filed: Jan. 31, 2002

(51) Int. Cl.[7] ..... H01Q 13/10
(52) U.S. Cl. ..... 343/770
(58) Field of Search ..... 343/767, 770, 343/768; H01Q 13/10

(56) References Cited

U.S. PATENT DOCUMENTS

| | | | | |
|---|---|---|---|---|
| 4,282,457 A | | 8/1981 | Harper | |
| 5,175,560 A | * | 12/1992 | Lucas et al. | 343/767 |
| 5,187,489 A | | 2/1993 | Whelan et al. | |
| 5,220,330 A | * | 6/1993 | Salvail et al. | 342/62 |
| 5,227,808 A | * | 7/1993 | Davis | 343/915 |
| 5,264,860 A | | 11/1993 | Quan | |
| 5,461,392 A | | 10/1995 | Mott et al. | |
| 5,502,372 A | | 3/1996 | Quan | |
| 5,557,291 A | | 9/1996 | Chu et al. | |
| 5,638,033 A | | 6/1997 | Walker et al. | |
| 5,659,326 A | | 8/1997 | McWhirter et al. | |
| 5,703,599 A | | 12/1997 | Quan et al. | |
| 5,721,551 A | | 2/1998 | Tran et al. | |
| 5,982,338 A | | 11/1999 | Wong | |
| 6,127,984 A | * | 10/2000 | Klebe et al. | 343/770 |
| 6,219,000 B1 | | 4/2001 | McWhirter et al. | |

* cited by examiner

*Primary Examiner*—Tho Phan
(74) *Attorney, Agent, or Firm*—Leonard A. Alkov; Glenn H. Lenzen, Jr.

(57) ABSTRACT

An antenna system includes an array of notch radiators, arranged in aligned rows on longitudinal axes to define a series of troughs between adjacent notch radiator rows within an aperture area, each notch radiator including a tip region. A plurality of surface/traveling wave suppressors fabricated of microwave energy absorbing material is disposed in the troughs, so that a longest suppressor dimension is transverse or nearly transverse to the array face and so that a suppressor surface is transverse or nearly transverse to the longitudinal axes.

21 Claims, 2 Drawing Sheets

SURFACE/TRAVELING WAVE SUPPRESSOR FOR ANTENNA ARRAYS OF NOTCH RADIATORS

TECHNICAL FIELD OF THE DISCLOSURE

This invention relates to antenna arrays, and more particularly to techniques for suppression of surface/traveling waves for antenna arrays of notch radiators.

BACKGROUND OF THE DISCLOSURE

Notch radiators are often used in two-dimensional antenna arrays because the sensor systems containing them require precise control over the antenna pattern, including wide bandwidth and the ability to scan the radiation over a wide range of angles. Typically, such an array is formed from "sticks," as illustrated in FIG. 1. Each stick 20, 22, . . . is a one-dimensional array composed of several adjacent notch radiators 30. The two-dimensional array is formed by aligning several sticks side by side such that an air channel or trough 24 separates each stick from the next. The portion of the trough farthest from the radiator tips may be occupied by a cross-polarization load 26 made of material that absorbs any radiation not captured by the radiator.

The outer surface of such an antenna array forms a complex, corrugated periodic structure that supports propagation of a variety of surface/traveling waves above it and within it. These waves interfere with the desired radiating wave needed for normal operation and can cause significant undesirable variations in the antenna patterns, including excessive radiation in unwanted directions and complete lack of radiation in desired directions. These pattern variations can degrade sensor system performance.

It has proven difficult to reduce undesirable contributions to the antenna pattern without also interfering with normal patterns and operation.

SUMMARY OF THE DISCLOSURE

An antenna system is disclosed which includes an array of notch radiators, arranged in aligned rows on longitudinal axes to define a series of troughs between adjacent notch radiator rows within an aperture area, each notch radiator including a tip region. A plurality of surface/traveling wave suppressors fabricated of microwave energy absorbing material is disposed in the troughs, so that a longest suppressor dimension is transverse or nearly transverse to the array face and so that a suppressor surface is transverse or nearly transverse to the longitudinal axes.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

In accordance with aspects of the invention, the electric and magnetic fields of the surface/traveling waves are selectively attenuated near the notch radiators of an antenna array. Attenuation of these near fields effectively reduces variations in the desired antenna pattern. The selectivity is angle-based rather than frequency-based, so undesirable waves traveling along the length of the sticks are attenuated without attenuating desirable radiation occurring in other directions. Angle-based selectivity here means that the attenuation occurs for a group of similar angles, whereas frequency-based selectivity would occur for a group of similar frequencies, e.g. a band-reject filter. The degree of attenuation and the reduction in pattern variation are both improved by the periodic placement of suppressors at the notch spacing or a sub-multiple thereof.

Two or three suppressors could alternatively be used for each notch radiator. Moreover, for some applications using multiple suppressors per notch, it may be desirable to have the suppressors spaced unequally. This placement minimizes the effect on the normal radiation pattern and allows the suppressor design to be accomplished concurrently with the radiator design, minimizing cost and schedule impact. In this manner, substantial attenuation can be achieved without significantly reflecting co-polarized and cross-polarized waves arriving from the front of the array, interfering significantly with the absorption of power by the cross-polarization loads, or interfering significantly with array performance in other ways. In addition, in some applications employing aspects of the invention, cross-polarized grating lobes that occur with almost all two-dimensional periodic arrays can be suppressed.

FIGS. 2–5 illustrate an antenna array 50 embodying surface/traveling wave suppressors in accordance with the invention. The array 50 includes a plurality of aligned sticks 52A, 52B . . . of notch radiators 54A, 54B, 54C . . . , 56A, 56B, 56C . . . 58*a*, 58*b*, 58*c*. . . , 60A, 60B, 60C . . . , 62A, 62B, 62C . . . The sticks are separated by troughs 64, 66, 68, 70, 72 . . . In this exemplary embodiment, cross-polarization loads 74, 76, 78, 80, 82 . . . are disposed in the bottoms of the respective troughs, although these loads can be omitted for some applications. Such loads are known in the art, e.g. U.S. Pat. No. 5,461,392, the entire contents of which are incorporated herein by this reference, discloses loads fabricated of a material which is chosen so as to be absorptive in the operating band of the array, but appear to be a relatively low loss dielectric at lower frequencies.

Figure 1:
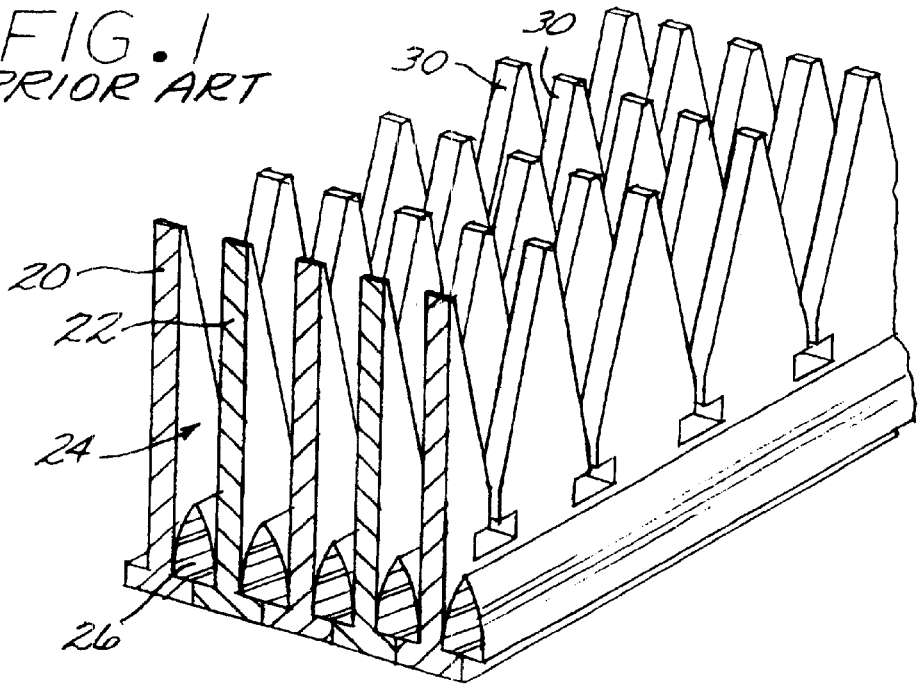
FIG. 1 PRIOR ART
FIG. 1 is a simplified diagrammatic isometric view of a portion of a two-dimensional antenna array comprising a set of sticks of adjacent notch radiators, aligned side by side such that a trough separates each stick from the next.
Figure 2:
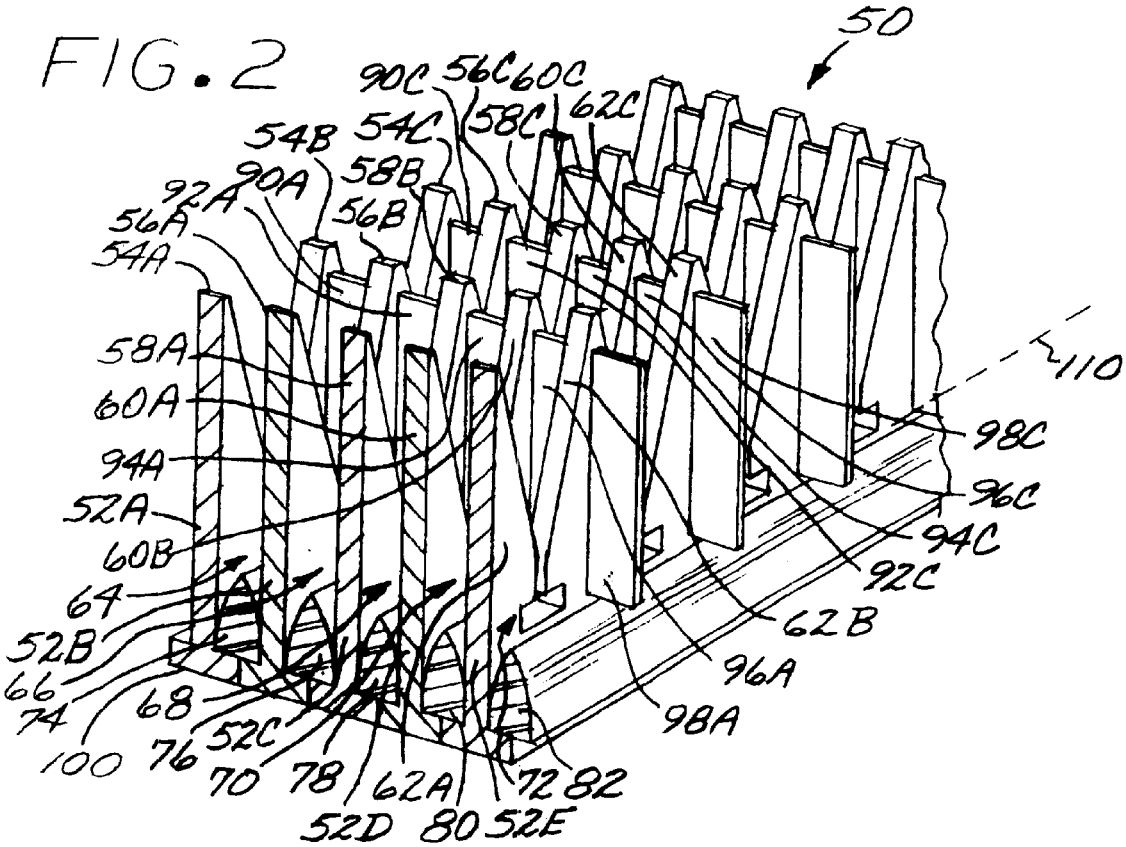
FIG. 2 is a simplified diagrammatic isometric view of a portion of a two-dimensional antenna array comprising a set of sticks of adjacent notch radiators and employing surface/traveling wave suppression in accordance with the invention.

In accordance with an aspect of the invention, one or more suppressors 90A, 90B, 90C . . . , 92A, 92B, 92C . . . , 94A, 94B, 94C, . . . , 96A, 96B, 96C . . . , 98A, 98B, 98C, . . . of microwave absorbing material are placed in the respective spaces 64–72 between consecutive sticks of notch radiators in the two-dimensional array to form a surface/traveling wave suppressor structure. Each suppressor is fabricated of one or more layers of microwave absorbing material, and is located away from the tips of the radiators. In an exemplary embodiment the suppressors are oriented perpendicular to both the face of the array and the longitudinal axes of the sticks. The face of the array is generally parallel to the ground plane 100. In this exemplary embodiment, the array face is the planar region encompassing the tips of all the notch radiators. Of course, for other arrays wherein the radiators are not regularly arranged such that tips define a plane, the array face may be a generalized region at the front of the array. The longitudinal axis 110 of stick 52E is shown in FIG. 2 as an example of a longitudinal stick axis.

Small tilts of the suppressors 90A, 90B, 90C . . . , 92A, 92B, 92C . . . , 94A, 94B, 94C, . . . , 96A, 96B, 96C . . . , 98A, 98B, 98C, . . . from the nominal perpendicular orientation can alternatively be employed, depending on requirements of a particular application. The suppressors may be, but need not be, shaped, i.e., with a geometrical shape other than rectangular. For example, the suppressors could be pointed at one end, or have a more complex, e.g., curved outer boundary. Their constitutive properties, such as permeability, permittivity and conductivity, may be varied with position or direction to optimize performance.

In an exemplary embodiment, the suppressor width is approximately equal to the trough width, and its long dimension or height extends from just above the balun region of the flared radiator to just below the radiator tip. However, other suppressor sizes could be employed for some applications, with smaller width and/or height dimensions. For example, for some applications, a suppressor having a shorter long dimension than the distance from just above the balun region to just below the radiator tip could be employed. Also the suppressor structure could be fabricated of more than a single substrate, i.e. smaller strips of substrates could be arranged as well in the troughs to make up a single suppressor structure.

More than one suppressor per radiator might be used. For example, two suppressors per radiator could be provided by sandwiching two dielectric substrates on either side of a support piece. The suppressors can be separate from or incorporated into the cross-polarization loads; they are shown as separate structures in FIG. 2.

Figure 3:
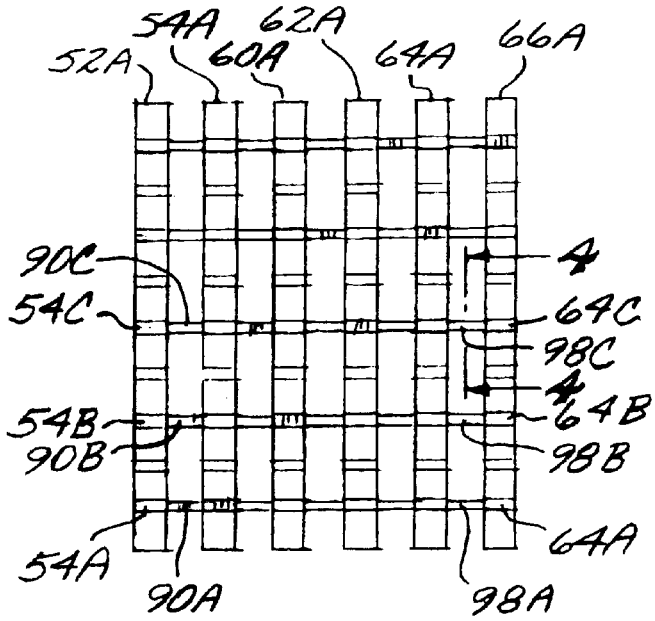
FIG. 3 is a top view of a portion of the antenna system of FIG. 1.
Figure 4:
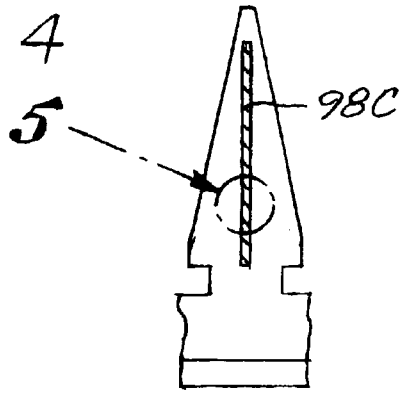
FIG. 4 is a partial cross-sectional view taken along line 4—4 of FIG. 3.
Figure 5:
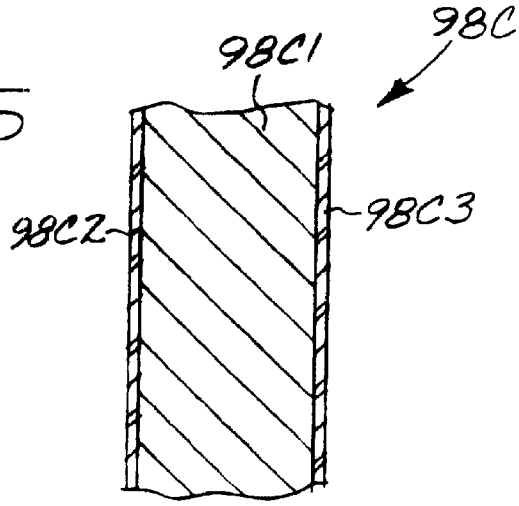
FIG. 5 is a cross-sectional view depicting a portion of an exemplary suppressor, in phantom circle 5 of FIG. 4.

The microwave absorbing layers comprising each suppressor in an exemplary embodiment are coatings on a broad surface of a dielectric substrate. FIG. 3 illustrates in cross-section one exemplary suppressor 98C, which comprises a substrate 98C1 having opposed surfaces, on which coatings 98C2 and 98C3 are applied. The substrate 98C1 may be fabricated of a low-loss dielectric material, or in another embodiment a lossy dielectric material. The primary function of the substrate is mechanical support of the microwave-absorbing layers. Some example substrates suitable for the purpose are polyimide, polyester, polycarbonate, quartz, TEFLON, and fiberglass although many other materials could alternatively be employed. The coatings 98C2 and 98C3 are selected to provide a resistance at the operating frequency band of the array. Examples of coatings suitable for the purpose in a given application include a layer of Kapton (™) marketed by Dupont, carbon paint, NiCr alloys and conductive polymers. While two coatings 98C2 and 98C3 are illustrated in the example of FIG. 3, in other embodiments, a single coating is sufficient. In fact, the coatings can be eliminated if the substrate material is lossy, i.e. microwave-absorptive. Further, the substrate could be a magnetically lossy structure, e.g., ferrites. Another exemplary substrate is one containing chiral absorbers.

An exemplary substrate thickness range for frequencies near 10 GHz is 0.010 inch to 0.030 inch. Exemplary coating thickness will depend on the coating material, but can approximate 0.1 micro-inch.

In a test array, the two long edges of each suppressor were positioned by a groove in the facing surfaces of each of two adjacent sticks, such that the suppressors were trapped between two sticks. Many other types of mechanical support can be employed.

It is understood that the above-described embodiments are merely illustrative of the possible specific embodiments that may represent principles of the present invention. Other arrangements may readily be devised in accordance with these principles by those skilled in the art without departing from the scope and spirit of the invention.

What is claimed is:

1. An antenna system comprising:

an array of notch radiators, arranged in aligned rows on longitudinal axes to define a series of parallel troughs between adjacent notch radiator rows within an aperture area and having a array face, each notch radiator including a tip region;

a plurality of surface/traveling wave suppressors fabricated of microwave energy absorbing material, the suppressors disposed in said troughs so that a longest suppressor dimension is transverse or nearly transverse to the array face and so that a suppressor surface is transverse or nearly transverse to the longitudinal axes.

2. The system of claim 1, wherein the plurality of wave suppressors each are disposed below a tip of a corresponding notch radiator.

3. The system of claim 1, wherein the plurality of wave suppressors each comprises a thin substrate having opposed outer surfaces, and a resistive coating applied on at least one of the outer surfaces.

4. The system of claim 3, wherein the resistive coating comprises a layer of carbon or NiCr alloy or a conductive polymer.

5. The system of claim 1, wherein the plurality of wave suppressors comprises a set of thin substrates having first and second opposed outer surfaces, and first and second resistive coatings applied respectively on the first and second outer surfaces.

6. The system of claim 1, wherein the plurality of wave suppressors each comprises a thin substrate having opposed outer surfaces, the substrate fabricated of a microwave absorbing material.

7. The system of claim 1, wherein the plurality of wave suppressors each comprises a thin substrate having opposed outer surfaces, the substrate fabricated of a lossy dielectric material.

8. The system of claim 1, wherein the plurality of wave suppressors each comprises a thin substrate having opposed outer surfaces, the substrate fabricated of a ferrite material.

9. The system of claim 1, wherein the plurality of suppressors are oriented to attenuate electromagnetic waves propagating along the troughs along the longitudinal axes without substantially attenuating electromagnetic waves propagating along directions other than along the longitudinal axes.

10. The system of claim 1, further comprising absorptive RF loading disposed at the bottom of each trough.

11. The system of claim 1, wherein the rows have a notch spacing, and wherein the surface/traveling wave suppressors in each trough are periodically positioned at a spacing equal to the notch spacing or a sub-multiple thereof.

12. The system of claim 1, wherein the plurality of suppressors each have a width dimension approximately equal to a trough width, and the longest dimension extends from just above a radiator balun region to just below the radiator tip.

13. An antenna system comprising:

an array of notch radiators, arranged in aligned sticks on longitudinal axes to define a series of parallel troughs between adjacent notch radiator rows within an aperture area and defining a array face, each notch radiator including a tip region;

a plurality of surface/traveling wave suppressors, comprising one or more layers for each radiator, the one or more layers fabricated of microwave energy absorbing material disposed in said troughs, so that a longest suppressor dimension is transverse or nearly transverse to the array face and so that a layer surface is transverse or nearly transverse to the longitudinal axes, wherein the plurality of suppressors are oriented to attenuate electromagnetic waves propagating along the troughs along the longitudinal axes without substantially attenuating electromagnetic waves propagating along directions other than along the longitudinal axes.

14. The system of claim 13, wherein the plurality of wave suppressors each are disposed below a tip of a corresponding notch radiator.

15. The system of claim 13, wherein the plurality of wave suppressors each comprises a thin substrate having first and second opposed outer surfaces, and a resistive coating applied on at least one of said first and second outer surfaces.

16. The system of claim 15, wherein the resistive coatings comprise a layer of carbon or NiCr alloy or a conductive polymer.

17. The system of claim 13, wherein the plurality of wave suppressors each comprises a thin substrate having opposed outer surfaces, the substrate fabricated of a microwave absorbing material.

18. The system of claim 13, wherein the plurality of wave suppressors each comprises a thin substrate having opposed outer surfaces, the substrate fabricated of a lossy dielectric material.

19. The system of claim 13, wherein the plurality of wave suppressors each comprises a thin substrate having opposed outer surfaces, the substrate fabricated of a ferrite material.

20. The system of claim 13, further comprising absorptive RF loading disposed at the bottom of each trough.

21. The system of claim 13, wherein the sticks have a notch spacing, and wherein the surface/traveling wave suppressors in each trough are periodically positioned at a spacing equal to the notch spacing or a sub-multiple thereof.

* * * * *